United States Patent [19]

Al-samman

[11] 4,402,102

[45] Sep. 6, 1983

[54] CORNER PAINT ROLLER

[76] Inventor: Ziad A. Al-samman, 1310 1/2 Linwood Ave., Los Angeles, Calif. 90017

[21] Appl. No.: 323,189

[22] Filed: Nov. 20, 1981

[51] Int. Cl.[3] ..... B44D 3/28

[52] U.S. Cl. ..... 15/230.11; 15/230.12; 15/230.19

[58] Field of Search ..... 15/230.11, 230.12, 230.19

[56] References Cited

U.S. PATENT DOCUMENTS

| | | | |
|---|---|---|---|
| 2,329,222 | 9/1943 | Schlegel | 15/230.12 |
| 2,959,800 | 11/1960 | Bischoff | 15/230.11 X |
| 3,394,423 | 7/1968 | Bischoff | 15/230.11 X |
| 3,662,422 | 5/1972 | Christensen et al. | 15/230.11 |
| 3,886,621 | 6/1975 | Welsh | 15/230.11 |
| 3,886,622 | 6/1975 | Horst | 15/230.12 X |

FOREIGN PATENT DOCUMENTS

| | | | |
|---|---|---|---|
| 1052877 | 3/1959 | Fed. Rep. of Germany | 15/230.11 |
| 1059649 | 11/1953 | France | 15/230.11 |
| 446971 | 3/1968 | Switzerland | 15/230.11 |

*Primary Examiner*—Chris K. Moore

[57] ABSTRACT

An improved corner junction paint roller comprised of a paint-roller corner-painting assembly that attaches to the end of a conventional paint roller. The attachment provides either a bristle end resembling a brush or a flat perpendicular end having a surface identical to the surface of the paint roller. By using the invention at the corner of one wall the adjacent corner wall is painted simultaneously. The improvement also includes a second embodiment that consists of replacing the standard paint roller with an extended version of the paint roller. The extended roller functions in a similar manner as described for the paint roller painting assembly. The extended roller is available with either a bristle end or a flat painting surface covered with a soft painting conducive material.

6 Claims, 6 Drawing Figures

Fig.1.
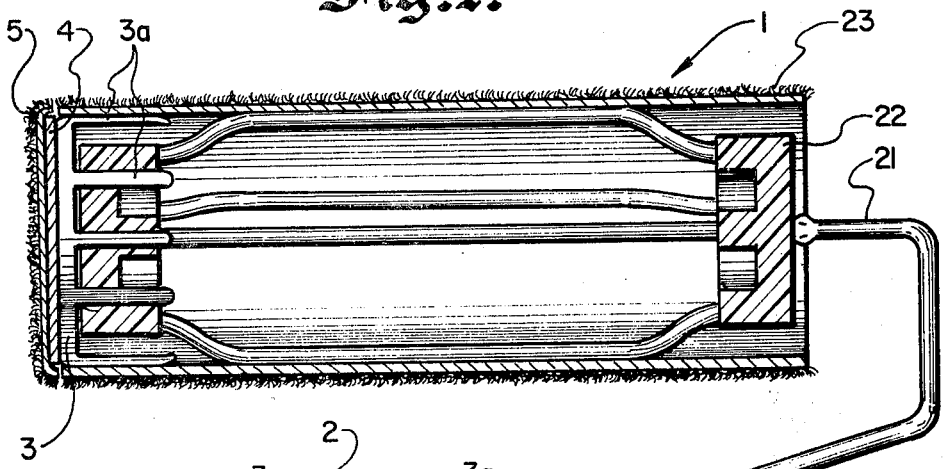
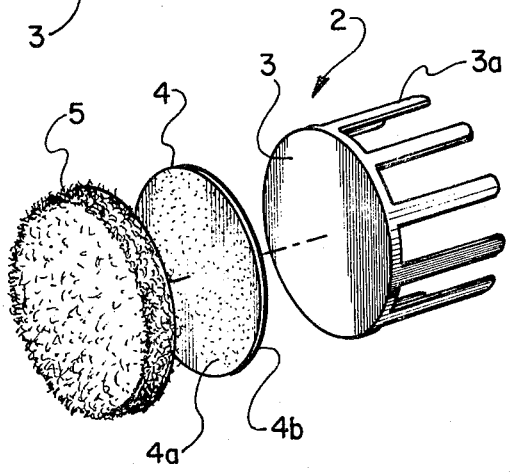
Fig.2.
Fig.3.
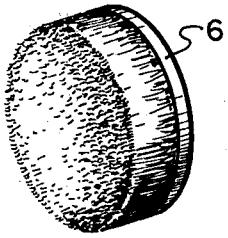
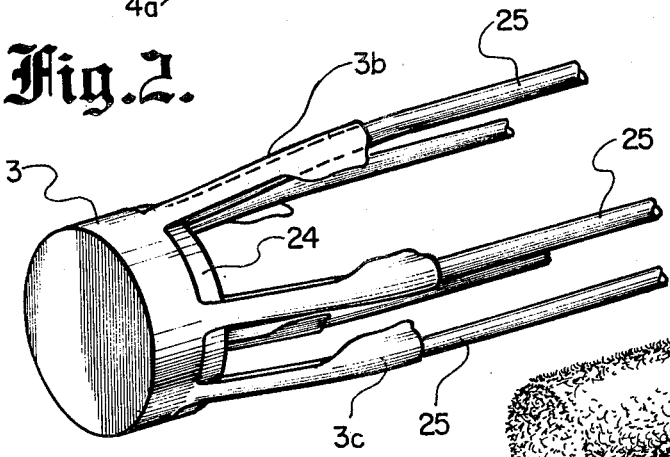
Fig.4.
Fig.5.
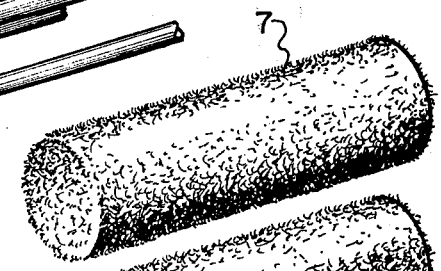
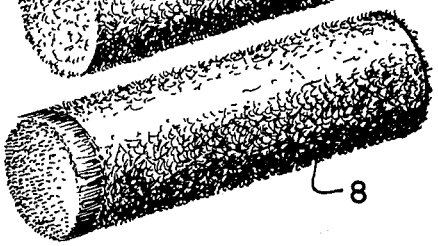
Fig.6.

applicator having a flat surface 5, as shown in FIGS. 1 and 2, has its entire surface covered with a soft pliable material such as cloth or polyester carpet fibers, or sponge rubber or plastic. The only requirement imposed on the pliable material is that the material be conducive to retaining paint and to provide an even distribution of the paint to the surface to be painted.

The other corner paint applicator 6 as shown in FIG. 3, has a multiplicity of elongated bristles. The bristles extend in an axial direction from the entire surface area of the non-attachment side of the applicator and are truncated perpendicular to the paint roller. Again the only requirement imposed on the brush is that the bristles retain paint and provide an even distribution of the paint to the surface to be painted.

To assemble the paint-roller corner-painting assembly 2 one of the protective shields **4*b* is peeled off to expose the contact surface of the dual attachment disk 4. To the exposed surface a corner paint applicator 5 or 6 is affixed. The other shield 4*b* is then removed and the subassembly consisting of the disk 4 and the paint applicator 5 or 6 is affixed to the concentric surface of the roller attachment base 3**.

The assembled paint-roller corner-painting assembly 2 is next attached to the conventional paint roller.

If the paint roller has a solid roller structure 22 a roller attachment base 3 having either flat fingers **3*a* or wire-like fingers is used. The base 3 is attached to the paint roller by inserting the fingers into the area between the roller structure 22 and the standard removable paint roller cylinder 23. This version of the assembly 2 is shown attached to the paint roller in FIG. 1**.

Some of the roller structures 22, as shown in FIGS. 1 and 4, have circular end caps 24 supporting a plurality of curved and resilient wire stringers 25. For use on this type of roller structure the roller attachment base 3 is designed with a plurality of fingers **3*b* having downwardly extending U-shaped clips 3*c* located at the end of each finger. To attach the base 3 to the roller structure 22 the paint roller cylinder 23 is removed and the base 3 is slipped over the roller structure and the clips 3*c* are snapped onto the wire stringers 25. The paint roller cylinder 23 is then inserted over the roller structure with the base 3** attached. At this point the preferred embodiment of the improved corner paint roller is ready for use.

An additional modification of the preferred embodiment consists of affixing a corner paint applicator 5 or 6 to the disk 4. The disk is then affixed to the end cap of the roller structure 22 by either using the contact cement surface of the disk or by attaching the disk 4 to the end cap by two small screws.

The second embodiment consists of replacing the standard paint roller cylinder with a paint roller cylinder having one end extending a short distance (from one to two inches) beyond the roller structure 22. There are two extended paint rollers disclosed. The first extended roller 7, as shown in FIG. 5 has a fully enclosed extended end that is truncated perpendicular to the roller and the entire surface of the paint roller including the extended end covered with a soft pliable material. The material consists of carpet-like fibers or their equivalent or sponge rubber, or plastic. Again the only requirement imposed on the material is that it retain paint and provide an even distribution of paint to the surface to be painted.

The second extended roller 8, as shown in FIG. 6, has the extended end terminating with a multiplicity of elongated bristles. The bristles extend in an axial direction and are truncated perpendicular to the roller.

Although the invention has been described in complete detail and pictorally shown in the accompanying drawings, it is not to be limited to such details since many changes and modifications may be made to the improved corner paint roller without departing from the spirit and scope thereof. Hence, the invention is described to cover any and all modifications and forms which may come within the language and scope of the claims.

I claim:

1. An improved corner paint roller comprising in combination:

(a) a conventional paint applicator of the roller type consisting of a paint roller axle and handle combination, a roller structure rotatably mounted on said axle, and a standard removable paint roller cylinder inserted over said roller structure, (b) a paint roller corner painting assembly comprising:

(1) a roller attachment base having means for attaching said base to the end of said roller structure on opposite side of said axle attachment end, (2) a corner paint applicator, and (3) a dual attachment disk having a contact-cement surface on each side, where said corner paint applicator is affixed to one side of said dual attachment disk and where other side of said dual attachment disk is affixed to said roller attachment base.

2. The improved corner paint roller as specified in claim 1 wherein said roller attachment base attaching means is comprised of a plurality of integral rigid fingers extending in an axial direction from the periphery of said base, on side opposite its attachment side to said dual attachment disk, where said fingers are inserted between said roller structure and said standard removable paint roller.

3. The improved corner paint roller as specified in claim 1 wherein said roller attachment base attaching means is comprised of a plurality of integral rigid fingers extending in an axial direction from the periphery of said base, on side opposite its attachment side to said dual attachment disk, where said fingers have downwardly extending U-shaped clips located at the end of each of said fingers where said clips are snapped onto wire stringers used on some models of said roller structure.

4. The improved corner paint roller as specified in claim 1 wherein said corner paint applicator consists of a flat surface having soft pliable material evenly spaced throughout the entire surface area of the non-attachment side of said applicator.

5. The improved corner paint roller as specified in claim 1 wherein said corner paint applicator has a multiplicity of elongated bristles extending in an axial direction from the entire surface area of the non-attachment side of said applicator.

6. The improved corner paint roller as specified in claim 4 wherein said soft pliable material is comprised of carpet-like fibers.

* * * * *

CORNER PAINT ROLLER

TECHNICAL FIELD

The invention pertains to the field of paint applicators and particularly to an improvement in paint applicators of the roller type. Specifically, the invention provides a means to allow the paint roller to apply paint to one corner wall while simultaneously applying paint to the opposite wall at the corner junction of the room.

BACKGROUND ART

The paint applicators of the roller type were disclosed in 1961 by U.S. Pat. No. 2,972,158 issued to Voskresenski. Since their introduction and subsequent availability to the general public there has been a prevailing problem that the roller does not adequately paint to the end of the wall at the corner junction of a room. To solve this problem attempts have been made to incorporate an end brush to the roller. The brushes disclosed by the prior art are limited to the bristle type which have an inherent dripping problem and are not cost-effective because of the complex modifications that must be made to the paint roller to accept the brush. The flexible paint rollers disclosed by the prior art are also of complex design and construction. Both the end brush and flexible roller disclosed do not offer the flexibility and ease of operation provided by the instant invention.

A search of the prior art did not disclose any patents that directly read on the instant invention. However, the following two U.S. patents were determined to be related:

| U.S. PAT. NO. | INVENTOR | ISSUED |
|---|---|---|
| 3,394,423 | Bischoff | 30 July 1968 |
| 2,959,800 | Bischoff | 15 November 1960 |

The first Bischoff patent (U.S. Pat. No. 2,959,800) discloses a design of a brush and a snap-on means for attaching the brush to the paint roller axle which at the same time holds the brush in assembly with the paint roller. The second Bischoff patent (U.S. Pat. No. 3,394,423) discloses a flexible paint roller containing a cluster of bristles attached to the periphery of a paint roller and extending beyond the free end of the roller.

DISCLOSURE OF THE INVENTION

The invention consists of two embodiments: the first is a paint-roller corner-painting assembly that attaches easily to the end of a conventional paint roller. The second is an extended paint roller that replaces the conventional standard paint roller. Both embodiments solve the problem of how to paint both sides of the corner junction of two room surfaces simultaneously. Both embodiments also provide two types of paint applicators a bristle type which is similar to a brush and a flat type applicator having a painting surface of the same material as the rest of the paint roller.

In addition to providing an efficient, expeditious and cost-effective method for painting a corner junction of a room it is also an objective of the invention to provide an invention that:

- can be effectively and efficiently used by both do-it-yourself and professional painters,
- can be easily manipulated by the user and eliminates or greatly reduces the problem of dripping and running paint,
- eliminates the need for hand brushing,
- can be easily and inexpensively manufactured, and
- is reliably constructed, long wearing and relatively free of maintenance problems.

BRIEF DESCRIPTION OF THE DRAWINGS

The details of the invention are described in connection with the accompanying drawings in which:

FIG. 1 is a sectional view of the invention showing the paint-roller corner-painting assembly attached to a conventional roller type paint applicator.

FIG. 2 is an exploded view showing the three components that comprise the paint-roller corner-painting assembly.

FIG. 3 is a perspective view of a corner paint applicator having elongated bristles extending in an axial direction.

FIG. 4 is a perspective view of a roller attachment base with downwardly extending U-shaped clips located at the end of each finger.

FIG. 5 is a perspective view of an extended paint roller where extended end is flat and is terminated perpendicular to the roller.

FIG. 6 is a perspective view of an extended paint roller where extended end terminates with a multiplicity of elongated bristles extending in an axial direction.

BEST MODE FOR CARRYING OUT THE INVENTION

The best mode for carrying out the invention of the improved corner paint roller 1 is described in terms of two embodiments with the first being the preferred embodiment. The numbering sequence 1–8 is applicable to the novel invention while the sequence 21–25 is applicable to the existing art in paint applicators of the roller type (paint roller).

The paint roller, as shown in FIG. 1, is comprised of three major components: a paint roller axle and handle combination 21, a roller structure 22, and a paint roller cylinder 23. The preferred embodiment, as shown in FIGS. 1, 2, 3 and 4 is comprised of a paint-roller corner-painting assembly 2 that attaches to the end of the paint roller. The assembly 2 is further comprised of three major components: a roller attachment base 3; a dual attachment disk 4; and a corner paint applicator 5 or 6.

The roller attachment base 3, as best shown in FIG. 2, has a diameter similar to that of the paint roller and a plurality of integral rigid fingers extending in an axial direction from the periphery of said base. The fingers extend on the side of the base opposite its attachment side to the dual attachment disk 4. In the best mode the base 3 is constructed of thin spring steel. However, any rigid material including various types of plastic may be used. Additionally, the fingers may be wire-like members shaped or flat members as shown in FIG. 2, or have clips at the end of each member as shown in FIG. 4.

The dual attachment disk 4 is concentric to the base 3 and is constructed of a rigid material such as steel or plastic where each side of the disk surface has a coating of contact-cement **4*a* or equivalent. Before the disk 4 is used both of the contact surfaces are protected by a peel-off non-contaminating shield of thin plastic 4*b***.

The corner paint applicator 5 or 6 is also concentric to the base 3 and disk 4 and may either have a flat painting surface or bristles respectively. The corner paint